US011056836B2

(12) United States Patent
Maesoba et al.

(10) Patent No.: US 11,056,836 B2
(45) Date of Patent: Jul. 6, 2021

(54) SHIELD TERMINAL COMPATIBLE WITH MULTIPLE HOUSINGS AND SHIELD CONNECTOR USING THE SAME

(71) Applicants: AutoNetworks Technologies, Ltd., Mie (JP); Sumitomo Wiring Systems, Ltd., Mie (JP); SUMITOMO ELECTRIC INDUSTRIES, LTD., Osaka (JP)

(72) Inventors: Hiroyoshi Maesoba, Mie (JP); Toshifumi Ichio, Mie (JP)

(73) Assignees: AutoNetworks Technologies, Ltd.; Sumitomo Wiring Systems, Ltd.; Sumitomo Electric Industries, Ltd.

( * ) Notice: Subject to any disclaimer, the term of this patent is extended or adjusted under 35 U.S.C. 154(b) by 114 days.

(21) Appl. No.: 16/492,591

(22) PCT Filed: Feb. 20, 2018

(86) PCT No.: PCT/JP2018/005822
§ 371 (c)(1),
(2) Date: Sep. 9, 2019

(87) PCT Pub. No.: WO2018/163788
PCT Pub. Date: Sep. 13, 2018

(65) Prior Publication Data

US 2021/0143585 A1 May 13, 2021

(30) Foreign Application Priority Data

Mar. 10, 2017 (JP) ..... JP2017-045881

(51) Int. Cl.
*H01R 13/6581* (2011.01)
*H01R 13/422* (2006.01)
(Continued)

(52) U.S. Cl.
CPC ..... *H01R 13/6581* (2013.01); *H01R 13/4226* (2013.01); *H01R 4/18* (2013.01);
(Continued)

(58) Field of Classification Search
CPC ..... H01R 13/6592; H01R 13/6593; H01R 13/65912; H01R 13/6581; H01R 9/0518;
(Continued)

(56) References Cited

U.S. PATENT DOCUMENTS 8,747,156 B2 * 6/2014 Hirabayashi ..... H01R 13/4223 439/595
8,926,368 B2 * 1/2015 Il ..... H01R 13/6581 439/607.5

(Continued)

FOREIGN PATENT DOCUMENTS

JP 61-133979 8/1986
JP 10-162888 6/1988

(Continued)

OTHER PUBLICATIONS

International Search Report dated Apr. 24, 2018.

*Primary Examiner* — Abdullah A Riyami
*Assistant Examiner* — Justin M Kratt
(74) *Attorney, Agent, or Firm* — Gerald E. Hespos; Michael J. Porco; Matthew T. Hespos

(57) ABSTRACT

A shield terminal (30) includes a dielectric (40) configured to accommodate inner conductors (32) and an outer conductor (43) surrounding the dielectric (40), and is mountable into a selected one of first housing (10) and a second housing (20). A first locking portion (55) and second locking portions (57) are formed on an outer surface of the outer conductor (40). The shield terminal (30) inserted into a first accommodation chamber (13) is retained by a front retainer (17) restricting the resilient deflection of a first locking lance (14)
(Continued)

and the first locking portion (55) being to the first locking lance (14). The shield terminal (30) inserted into a second accommodation chamber (21) is retained by the locking of the first locking portion (55) and a second locking lance (22) and the locking of the second locking portions (57) and a side retainer (24).

5 Claims, 10 Drawing Sheets

(51) Int. Cl.

| | |
|---|---|
| *H01R 13/506* | (2006.01) |
| *H01R 4/18* | (2006.01) |
| *H01R 13/6592* | (2011.01) |
| *H01R 9/05* | (2006.01) |
| *H01R 13/6582* | (2011.01) |
| *H01R 13/6593* | (2011.01) |
| *H01R 13/648* | (2006.01) |
| *H01R 13/6591* | (2011.01) |

(52) U.S. Cl.
CPC ..... *H01R 4/184* (2013.01); *H01R 9/0518* (2013.01); *H01R 13/506* (2013.01); *H01R 13/648* (2013.01); *H01R 13/6582* (2013.01); *H01R 13/6592* (2013.01); *H01R 13/6593* (2013.01); *H01R 13/65912* (2020.08)

(58) Field of Classification Search
CPC ..... H01R 13/6582; H01R 13/506; H01R 13/648; H01R 4/18; H01R 4/184; H01R 13/4226
USPC ..... 439/607.41, 607.5, 595, 871
See application file for complete search history.

(56) References Cited

U.S. PATENT DOCUMENTS

| | | | | |
|---|---|---|---|---|
| 10,862,237 | B2 * | 12/2020 | Jin | H01R 13/424 |
| 2015/0155670 | A1 | 6/2015 | Gardner | |

FOREIGN PATENT DOCUMENTS

| | | |
|---|---|---|
| JP | 7-176342 | 7/1995 |
| JP | 10-321280 | 4/1998 |
| JP | 2002-319456 | 10/2002 |
| JP | 2012-129103 | 7/2012 |
| JP | 2013-125585 | 6/2013 |
| JP | 2015-537327 | 12/2015 |

* cited by examiner

SHIELD TERMINAL COMPATIBLE WITH MULTIPLE HOUSINGS AND SHIELD CONNECTOR USING THE SAME

BACKGROUND

Field of the Invention

The invention relates to a shield terminal and a shield connector.

Related Art

Japanese Unexamined Patent Publication No. 2012-129103 discloses a shield connector with a terminal unit that has an inner conductor terminal in a dielectric. An outer conductor forms a shield terminal by surrounding the terminal unit and a housing accommodates the shield terminal. A resiliently deflectable locking lance is formed in the housing and is locked to a locking projection formed on an outer surface of the outer conductor for retaining and holding the shield terminal in the housing.

There is a concern that the resiliently deflectable locking lance may be disengaged from the locking projection due to an impact, vibration or the like. Thus, it is desired to improve the reliability of a function for retaining the shield terminal.

The invention was completed on the basis of the above situation and aims to improve the reliability of a function for retaining a shield terminal.

SUMMARY

A first aspect of the invention is directed to a shield terminal with an inner conductor having a tab projecting forward from a body, a dielectric configured to hold the inner conductor while accommodating the body, and an outer conductor surrounding the dielectric and the tab. The shield terminal is mountable into a selected one of a first housing and a second housing. The first housing includes a resiliently deflectable first locking lance, a front retainer capable of restricting resilient deflection of the first locking lance and a first accommodation chamber. The second housing includes a resiliently deflectable second locking lance, a second accommodation chamber and a side retainer facing inside of the second accommodation chamber. A first locking portion and a second locking portion are formed on an outer surface of the outer conductor. The shield terminal that is inserted in the first accommodation chamber is retained by the front retainer restricting the resilient deflection of the first locking lance and the first locking portion being locked to the first locking lance, and the shield terminal that is inserted into the second accommodating chamber is retained by locking of the first locking portion and the second locking lance and locking of the second locking portion and the side retainer.

A second aspect of the invention is directed to a shield connector that has a shield terminal including an inner conductor having a tab projecting forward from a body, a dielectric configured to hold the inner conductor while accommodating the body and an outer conductor surrounding the dielectric and the tab. The shield connector is configured by inserting the shield connector into a selected one of a first accommodation chamber formed in a first housing and a second accommodation chamber formed in a second housing. The shield connector includes a resiliently deflectable first locking lance formed in the first accommodation chamber, a front retainer configured to restrict resilient deflection of the first locking lance by being mounted into the first housing. The shield connector also includes a resiliently deflectable second locking lance formed in the second accommodation chamber, a side retainer mounted into the second housing to face inside of the second accommodation chamber. A first locking portion is formed on an outer surface of the outer conductor and is configured to retain the shield terminal by being locked to the first locking lance when the shield terminal is inserted into the first accommodation chamber and to retain the shield terminal by being locked to the second locking lance when the shield terminal is inserted into the second accommodation chamber. A second locking portion is formed on the outer surface of the outer conductor and is configured to retain the shield terminal by being locked to the side retainer when the shield terminal is inserted into the second accommodation chamber.

When the shield terminal is inserted into the first accommodation chamber, the first locking portion is locked to the first locking lance and the front retainer is mounted into the first housing to restrict the resilient deflection of the locking lance so that the shield terminal can be retained reliably. When the shield terminal is inserted into the second accommodation chamber, the second locking portion is locked to the second locking lance and the side retainer is locked to the second locking portion so that the shield terminal can be retained reliably. Thus, the shield terminal can be used as a common member for the first and second housings of different types.

The first and second locking portions may be formed on the same plane of the outer surface of the outer conductor and may be at different positions in a width direction intersecting an inserting direction into the first or second accommodation chamber. According to this configuration, the first locking portion can avoid interference with the side retainer and the second locking portion can avoid interference with the first and second locking lances while the first and second locking portions are arranged on the same plane.

The first locking portion may be at a center position in the width direction intersecting the inserting direction into the first or second accommodation chamber, and two of the second locking portions may be on both sides across the first locking portion in the width direction. According to this configuration, since two projections spaced apart in the width direction are locked to the side retainer, the shield terminal cannot be tilted laterally.

A front stop may be formed in a planar region of the outer surface of the outer conductor different from a planar region where the first locking portion is formed and may be configured to restrict a movement of the shield terminal inserted into the first accommodation chamber or the second accommodation chamber beyond a proper insertion position. The planar region where the front stop is formed is different from the planar region where the first locking portion is formed. Thus, the first and second locking lances do not resiliently contact the front stop, and there is no insertion resistance due to resilient interference of the front stop with the first or second locking lance.

DETAILED DESCRIPTION

An embodiment of the invention is described with reference to FIGS. 1 to 11. Note that, in the following description, a left side in FIGS. 1 to 11 is defined as a front side concerning a front-rear direction. Upper and lower sides shown in FIGS. 1 to 3, 5 to 8, 10 and 11 are directly defined as upper and lower sides concerning a vertical direction. A shield terminal 30 of this embodiment constitutes a first shield connector A (shield connector as claimed) of a waterproof type by being mounted into a first housing 10 and constitutes a second shield connector B (shield connector as claimed) of a non-waterproof type by being mounted into a second housing 20.

Figure 1:
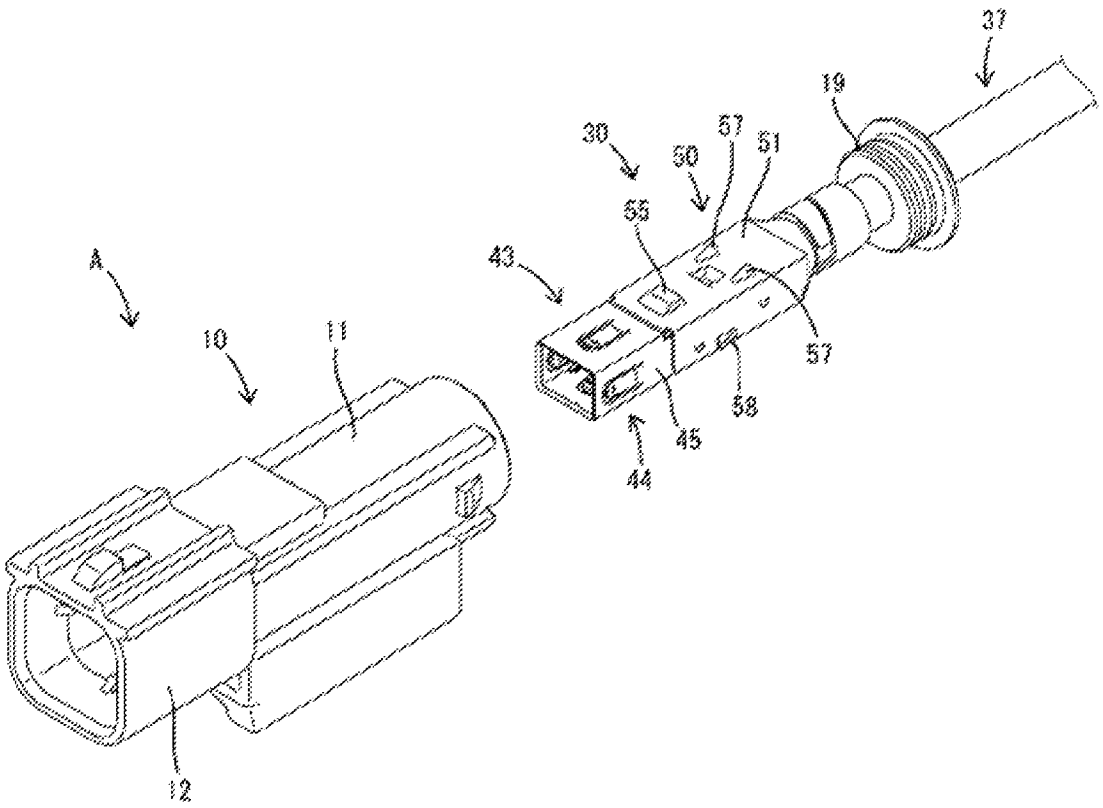
FIG. 1 is a perspective view showing a state where a first housing and a shield terminal are separated in a first shield connector of one embodiment.
Figure 2:
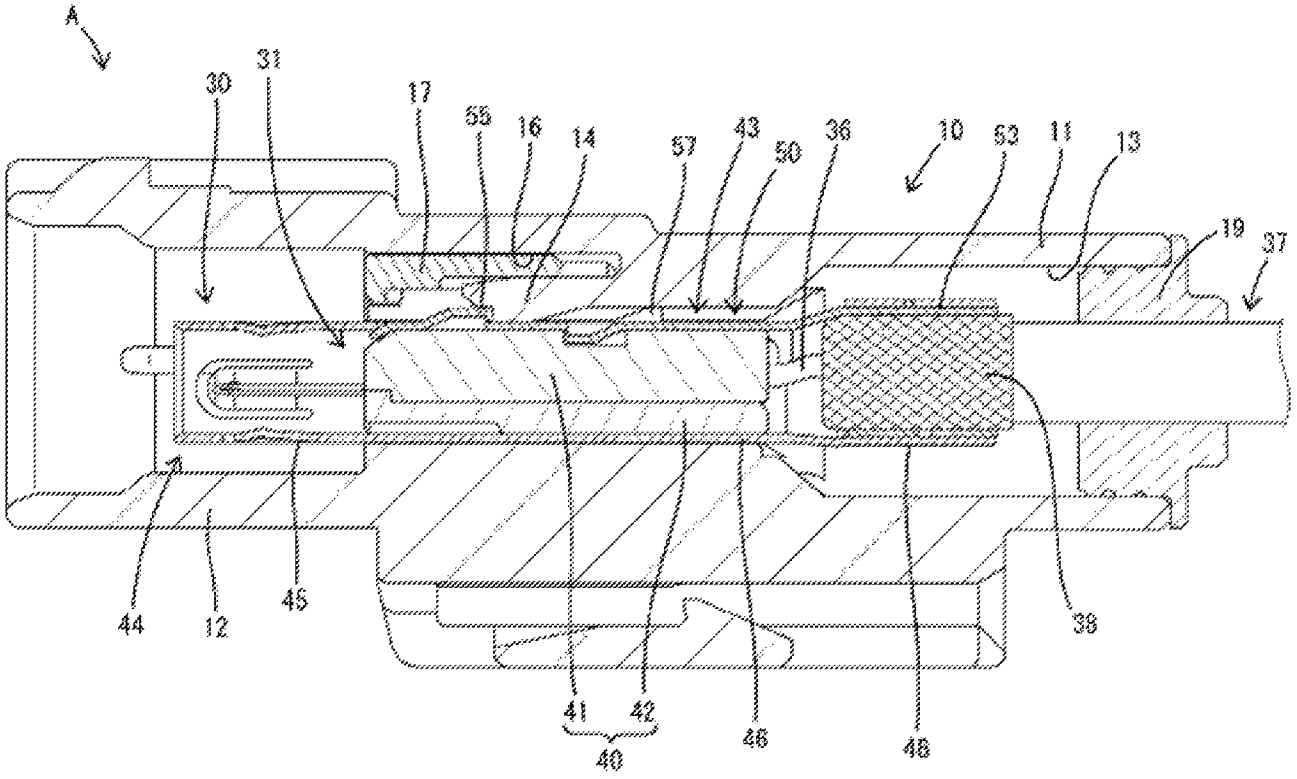
FIG. 2 is a side view in section showing a state where a front retainer is at a full locking position in the first shield connector.
Figure 3:
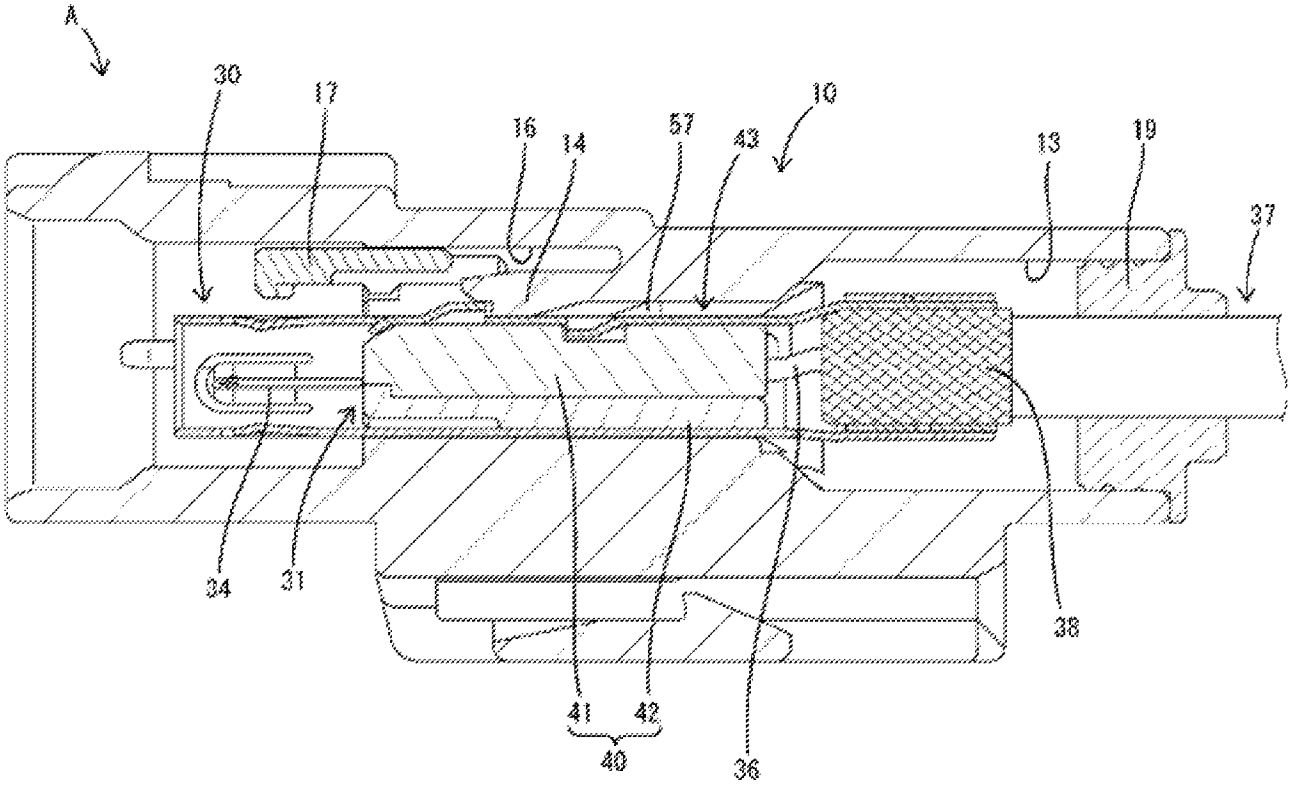
FIG. 3 is a side view in section showing a state where the front retainer is at a partial locking position in the first shield connector.
Figure 4:
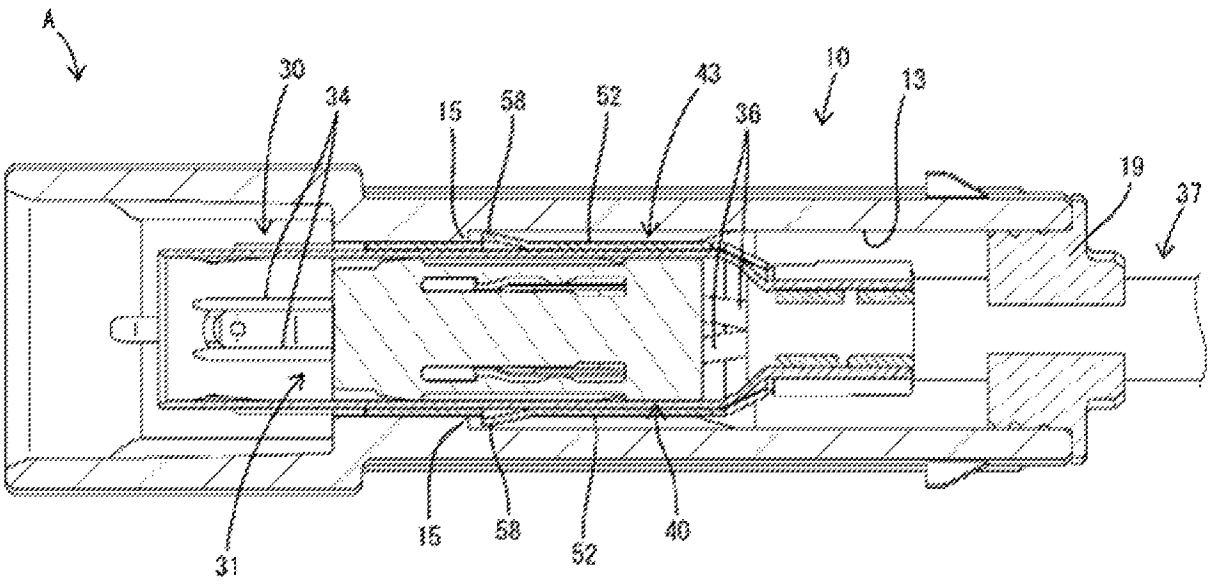
FIG. 4 is a plan view in section showing a state where the shield terminal is stopped in front in the first shield connector.
Figure 5:
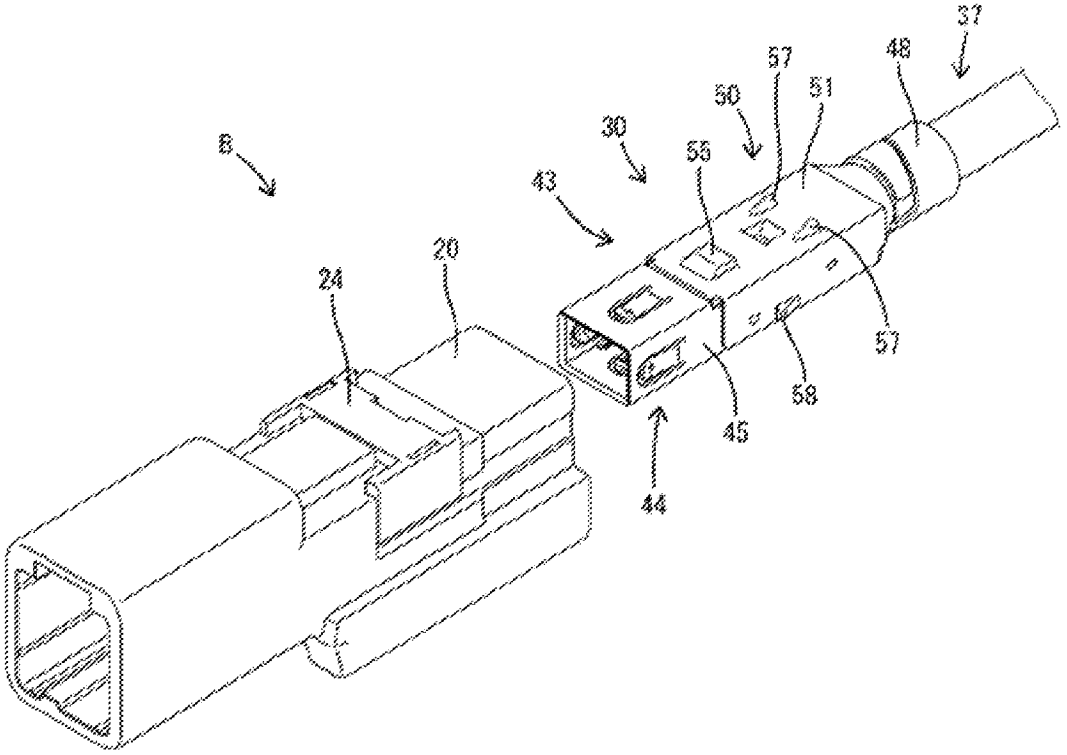
FIG. 5 is a perspective view showing a state where a second housing and the shield terminal are separated in a second shield connector.

The first housing 10 is made of synthetic resin and, as shown in FIGS. 2 to 4, is a single component including an accommodating portion 11 and a receptacle 12 extending forward from the outer periphery of the front end of the accommodating portion 11. A first accommodation chamber 13 is formed inside the accommodating portion 11. The shield terminal 30 is inserted into the accommodation chamber 13 from behind the first housing 10. A first locking lance 14 is cantilevered forward from an inner upper surface of the first accommodation chamber 13 and is resiliently deflectable upward. Step-like first stoppers 15 (see FIG. 4) are formed on both left and right side surfaces inside first accommodation chamber 13.

The accommodating portion 11 is formed with a deflection space 16 for allowing the first locking lance 14 to be deflected resiliently upward. A front retainer 17 is mounted into the accommodating portion 11 from the front of the first housing 10. The front retainer 17 mounted in the accommodating portion 11 is movable in the front-rear direction between a partial locking position where the front retainer 17 is forward of the deflection space 16 to allow the resilient deflection of the first locking lance 14 as shown in FIG. 3 and a full locking position where the front retainer 17 enters the deflection space 16 to restrict the resilient deflection of the first locking lance 14 as shown in FIG. 2. The deflection space 16 is not open in the outer peripheral surface of the accommodating portion 11 and is open in the front surface of the accommodating portion 11.

Figure 6:
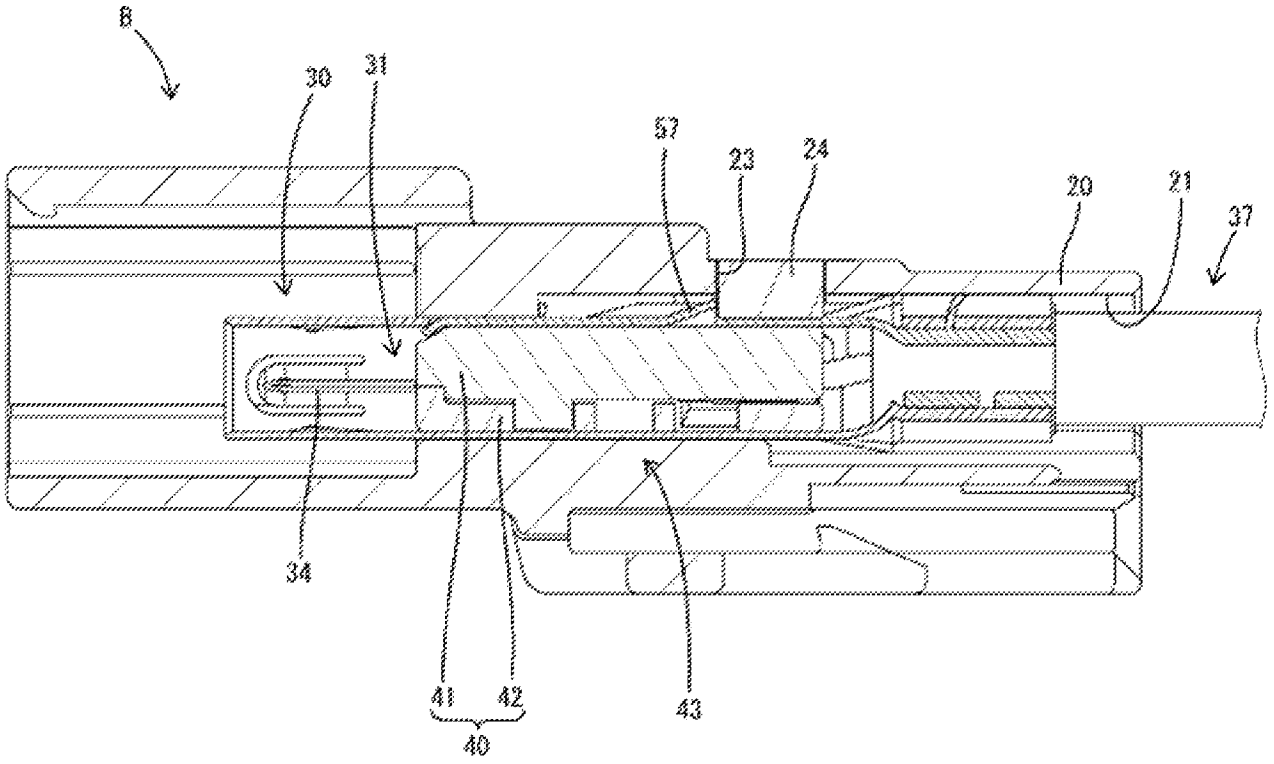
FIG. 6 is a side view in section showing a state where a side retainer is at a full locking position in the second shield connector.
Figure 7:
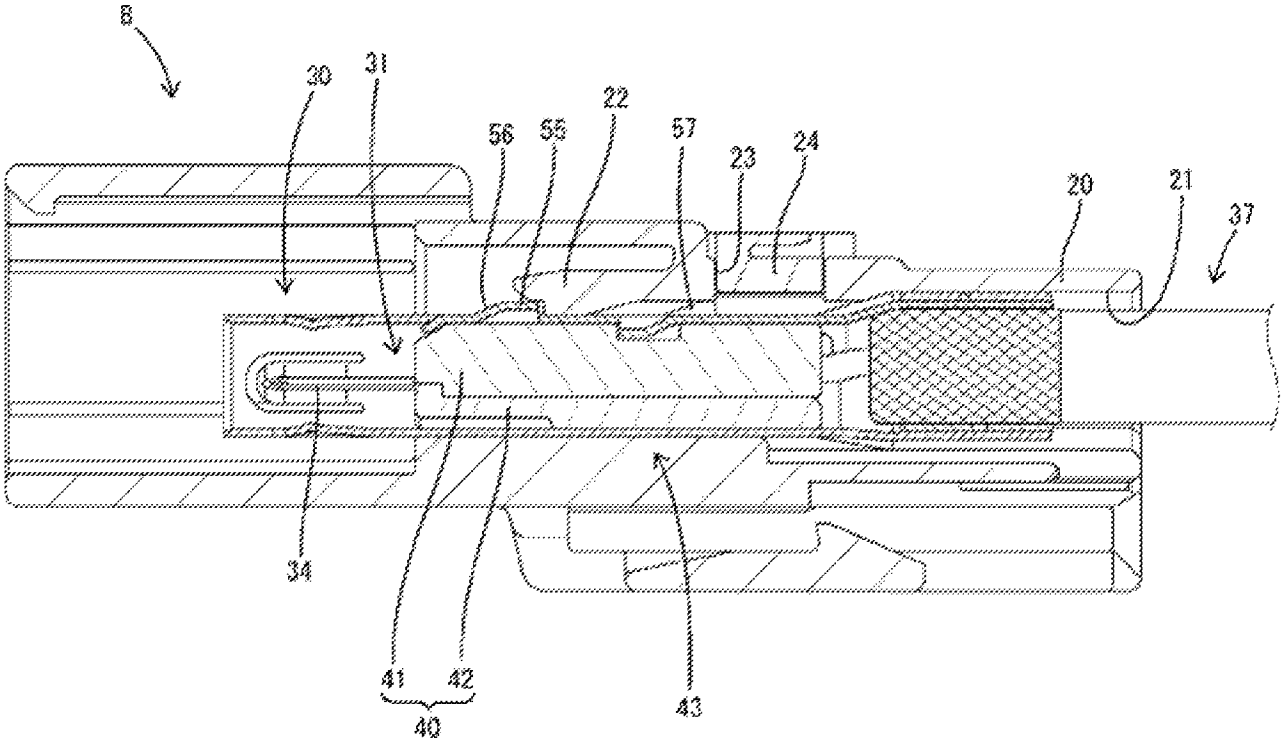
FIG. 7 is a side view in section showing a state where the side retainer is at a partial locking position in the second shield connector.
Figure 8:
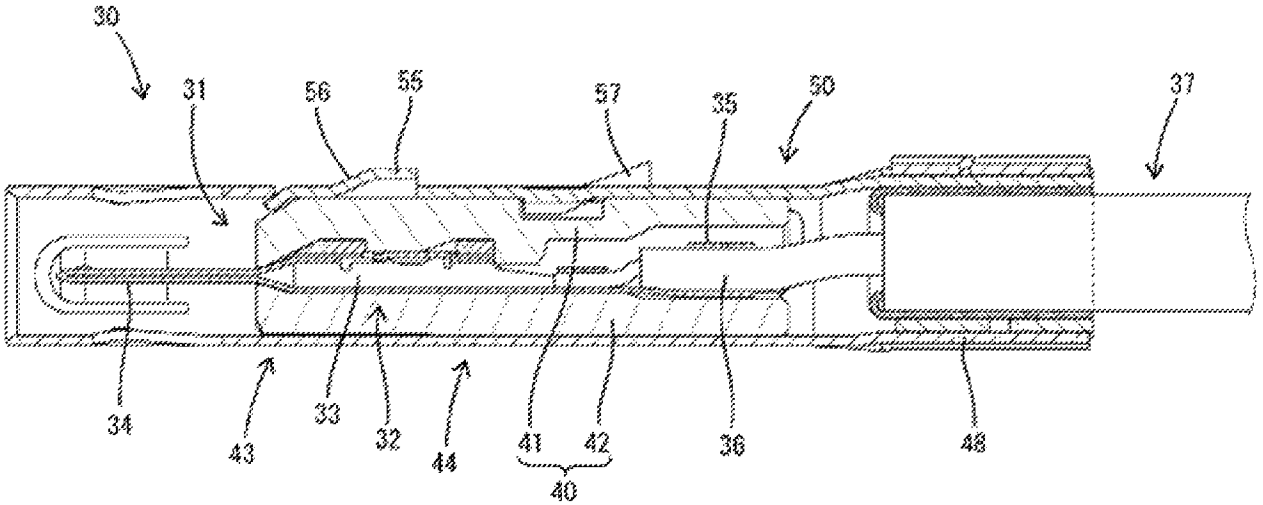
FIG. 8 is a side view in section of the shield terminal.
Figure 9:
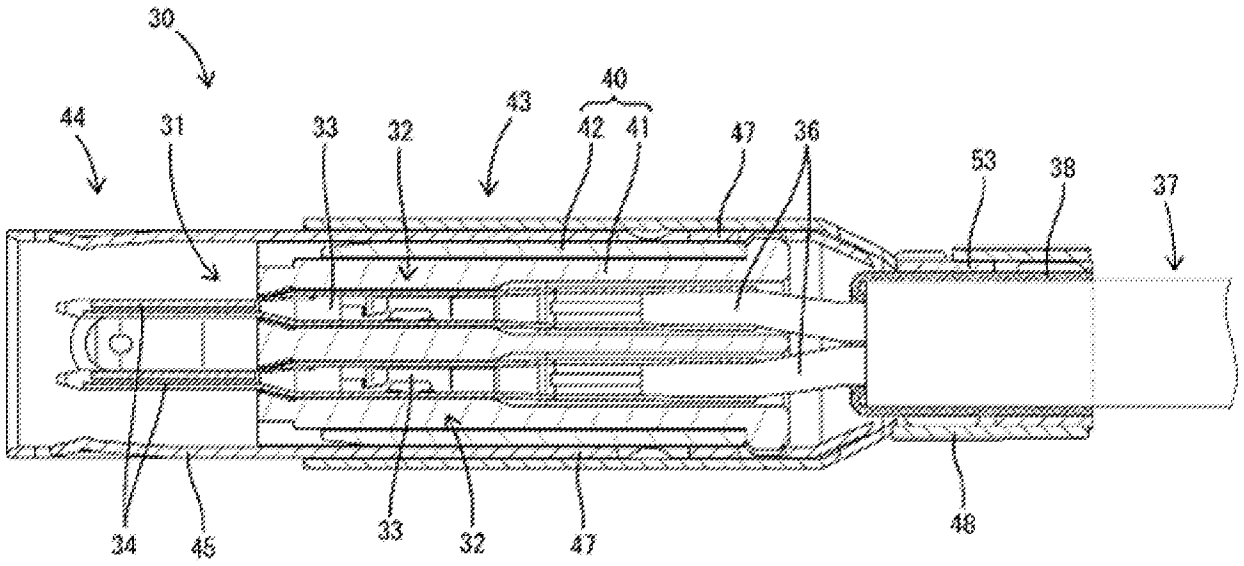
FIG. 9 is a plan view in section of the shield terminal.

The second housing 20 is made of synthetic resin. As shown in FIGS. 6 and 7, a second accommodation chamber 21 is formed inside the second housing 20. The shield terminal 30 is inserted into the second accommodation chamber 21 from behind the second housing 20. A second locking lance 22 cantilevered forward and resiliently deflectable upward is formed on an inner upper surface of the second accommodation chamber 21. Second stoppers (not shown) having the same shape (step-like shape) as the first stoppers 15 are formed on both left and right side surfaces inside the second accommodation chamber 21.

A mounting hole 23 is formed through the upper surface of the second housing 20 is formed with a mounting hole 23 and communicates with the inside of the second accommodation chamber 21. The mounting hole 23 is disposed behind the second locking lance 22. A side retainer 24 is mounted into the mounting hole 23 and is movable in the vertical direction (direction intersecting an inserting/withdrawing direction of the shield terminal 30 into and from the second accommodation chamber 21) between a partial locking position where the side retainer 24 is retracted to the outside of the second accommodation chamber 21 as shown in FIG. 7 and a full locking position where the side retainer 24 is located in the accommodation chamber 21 as shown in FIG. 6.

The shield terminal 30 is a connecting member constituting a wiring harness for Ethernet (registered trademark) high-speed communication circuit of an automotive vehicle. The shield terminal 30 has a terminal unit 31 surrounded by a rectangular tubular outer conductor 43 made of a metal material. The terminal unit 31 is configured by accommodating two inner conductors 32 into a dielectric 40.

The inner conductor 32 is long in the front-rear direction and has a rectangular tubular body 33. An elongated tab 34 projects forward from the body 33, and a crimping portion 35 in the form of an open barrel is connected to the rear end of the body 33. A front part of a wire 36 is fixed conductively fixed to the crimping portion 35. Two of the wires 36 connected to two inner conductors 32 constitute a twisted pair cable 37. The dielectric 40 is configured by vertically uniting a first component 41 made of synthetic resin and having a halved shape and a second component 42 made of synthetic resin and having a halved shape.

The outer conductor 43 is configured by uniting a first shell 44 having a halved shape and a second shell 50 having a halved shape to sandwich the terminal unit 31 therebetween. First and second barrels 48, 53 formed on a rear end part of the outer conductor 43 are conductively fixed to a braided wire 38 of the twisted pair cable 37. The shield terminal 30 fixed to the twisted pair cable 37 is mounted into the first housing 10 and the second housing 20 by being inserted therein from behind.

Figure 10:
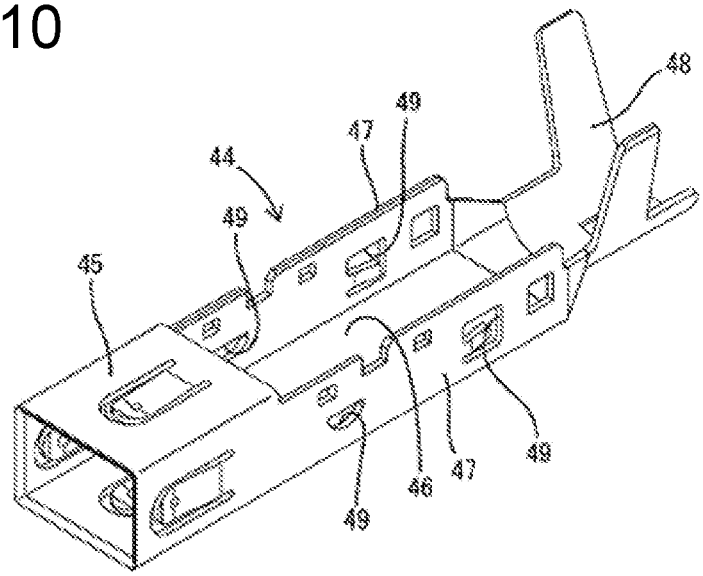
FIG. 10 is a perspective view of a first shell.

As shown in FIG. 10, the first shell 41 includes a rectangular tubular receptacle 45, a bottom plate 46 extending rearward from the receptacle 45, left and right side plates 47 standing up from both left and right sides of the bottom plate 46, and the first barrel portion 48 in the form of an open barrel connected to the rear end of the bottom plate 46. Front and rear lock holes 49 are formed in each of the side plates 47 by recessing parts of the side plates 47 on an outer surface side.

Figure 11:
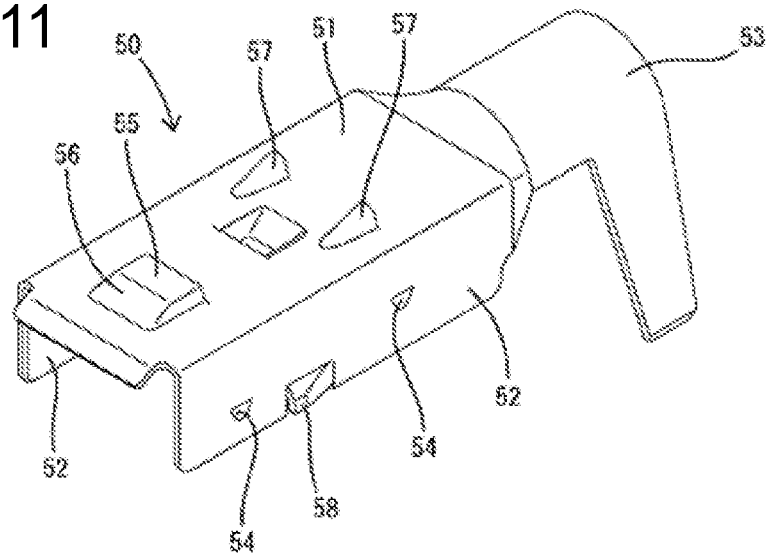
FIG. 11 is a perspective view of a second shell.

As shown in FIG. 11, the second shell 50 includes an upper plate 51 long in the front-rear direction, left and right outer plates 52 extending down from both left and right sides of the upper plate 51 and the second barrel 53 in the form of an open barrel connected to the rear end of the upper plate 51. Front and rear lock projections 54 are formed on each outer plate 52 by causing parts of the inner surface of the outer plate 52 to project.

A projection-like first locking portion 55 is formed integrally on the upper surface (outer surface) of the upper plate 51. The first locking portion 55 is formed by cutting a part of the upper plate 51 and raising the cut part upward. The first locking portion 55 is disposed on a front part of the upper plate 51 in the front-rear direction and in a center of the upper plate 51 in a lateral direction. A front part of the first locking portion 55 is formed with an inclined surface 56 inclined with respect to the front-rear direction (inserting direction of the shield terminal 30 into the housing). A rear surface of the first locking portion 55, which is a cut and raised surface, serves as a locking surface substantially at a right angle to the front-rear direction.

Left and right second locking portions 57 are formed on the upper surface (outer surface) of the upper plate 51. The left and right second locking portions 57 are formed by cutting parts of the upper plate 51 and raising the cut parts. Rear end surfaces of the second locking portions 57, which are cut and raised surfaces, serve as locking surfaces substantially at a right angle to the front-rear direction. The left and right second locking portions 57 are disposed substantially at center positions (i.e. positions behind the first locking portion 55) in the front-rear direction and outwardly of the first locking portion 55 in the lateral direction.

The left and right outer plates 52 are formed with two front stops 58. Each front stop 58 is formed by cutting a part of the outer plate 52 and raising the cut part. A front surface of the front stop 58, which is a cut and raised surface, serves as a front stop surface substantially at a right angle to the front-rear direction. The front stop 58 is disposed at a position in front of a center of the outer plate 52 in the front-rear direction and between the first locking portion 55 and the second locking portions 57. The front stop 58 is on a lower end part of the outer plate 52 in the vertical direction.

The first and second shells 44 and 50 are assembled by first mounting the terminal unit 31 into the first shell 44. At this time, the dielectric 40 is accommodated into a concave part constituted by the bottom plate 46 and the left and right side plates 47, and the tabs 34 projecting forward from the front end surface of the dielectric 40 are surrounded by the receptacle 45. The second shell 50 is united with the first shell 44 from above after the terminal unit 31 is mounted into the first shell 44.

At this time, the outer plates 52 of the second shell 50 are overlapped on the outer surfaces of the side plates 47 of the first shell 44, and the lock holes 49 are locked to the lock projections 54 to configure the outer conductor 43. The terminal unit 31 then is accommodated in the outer conductor 43 to complete the assembling of the shield terminal 30.

A rubber plug 19 is mounted on the outer periphery of the twisted pair cable 37 in advance and the shield terminal 30 is inserted into the first accommodation chamber 13 from behind the first housing 10 with the front retainer 17 held at the partial locking position. In the process of inserting the shield terminal 30, the inclined surface 56 of the first locking portion 55 resiliently deflects the first locking lance 14.

When the shield terminal 30 is inserted properly, the front stops 58 butt against the first stoppers 15 to stop the shield terminal 30 in front, and the first locking portion 55 is locked to the first locking lance 14 to retain the shield terminal 30 with respect to the first housing 10. Further, the rubber plug 19 closes an opening on the rear end of the first accommodation chamber 13 in a liquid-tight manner. In the above way, the shield terminal 30 achieves primary locking.

After the shield terminal 30 is inserted properly, the front retainer 17 is pushed from the partial locking position to the full locking position to enter the deflection space 16. In this way, the resilient deflection of the first locking lance 14 in a direction separating from the first locking portion 55 is restricted to achieve secondary locking of the shield terminal 30. As just described, the shield terminal 30 is retained reliably by primary locking by the first locking lance 14 and secondary locking by the front retainer 17.

In mounting the shield terminal 30 into the second housing 20, the shield terminal 30 is inserted into the second accommodation chamber 21 with the side retainer 24 held at the partial locking position. In the process of inserting the shield terminal 30, the inclined surface 56 of the second locking portion 55 resiliently deflects the second locking lance 22. When the shield terminal 30 is inserted properly, the front stops 58 butt against the second stoppers to stop the shield terminal 30 in front and the first locking portion 55 is locked to the second locking lance 22 to retain the shield terminal 30 with respect to the second housing 20. In the above way, the shield terminal 30 achieves primary locking.

After the shield terminal 30 is inserted properly, the side retainer 24 is pushed from the partial locking position to the full locking position to enter the second accommodation chamber 21. In this way, the side retainer 24 is locked to the second locking portions 57 from behind to achieve secondary locking of the shield terminal 30. As just described, the shield terminal 30 is retained reliably by primary locking by the second locking lance 22 and secondary locking by the side retainer 24.

The first shield connector A of this embodiment is configured by inserting the shield terminal 30 into the first accommodation chamber 13 formed in the first housing 10. Further, the second shield connector B is configured by inserting the shield terminal 30 into the second accommodation chamber 21 formed in the second housing 20.

The shield terminal 30 includes the terminal unit 31 and the outer conductor 43. The terminal unit 31 includes the two inner conductors 32 having the tabs 34 projecting forward from the bodies 33, and the dielectric 40 configured to hold the inner conductors 32 while accommodating the bodies 33 inside. The terminal unit 31 is accommodated in the outer conductor 43.

This shield terminal 30 is mounted into a selected one of the first housing 10 and the second housing 20. In other words, the shield terminal 30 can be mounted into either one of the first housing 10 and the second housing 20 according to need.

The first housing 10 includes the resiliently deflectable first locking lance 14, the front retainer 17 capable of restricting the resilient deflection of the first locking lance 14 and the first accommodation chamber 13. The second housing 20 includes the resiliently deflectable second locking lance 22, the second accommodation chamber 21 and the side retainer 24 facing the inside of the second accommodation chamber 21.

The first locking portion 55 and the second locking portions 57 are formed on the outer surface of the outer conductor 43. With the shield terminal 30 inserted in the first accommodation chamber 13, the first locking portion 55 is locked to the first locking lance 14 and the front retainer 17 restricts the resilient deflection of the first locking lance 14. In the above way, the shield terminal 30 is retained reliably. Further, with the shield terminal 30 inserted in the second accommodation chamber 21, the shield terminal 30 is retained reliably by the locking of the first locking portion 55 and the second locking lance 22 and by the locking of the second locking portions 57 and the side retainer 24.

As just described, the reliability of a function for retaining the shield terminal 30 is excellent regardless of whether the shield terminal 30 is mounted into the first housing 10 or the second housing 20. Further, the shield terminal 30 can be used as a common member for the waterproof first housing 10 and the non-waterproof second housing 20, which are of different types.

Further, the first locking portion 55 and the second locking portions 57 are formed on the same plane of the outer surface of the outer conductor 43 (outer surface of the upper plate portion 51) and are disposed at different positions in a width direction (lateral direction) intersecting the inserting direction into the first or second accommodation chamber 13 or 21. According to this configuration, the first locking portion 55 can avoid interference with the side retainer 24, and the second locking portions 57 can avoid interference with the first and second locking lances 14, 22 while the first locking portion 55 and the second locking portions 57 are arranged on the same plane.

Further, the first locking portion 55 is at the center position of the upper plate 51 in the width direction (lateral direction) intersecting the inserting direction into the first or second accommodation chamber 13 or 21, and the second locking portions 57 are on both sides across the first locking portion 55 in the width direction. According to this configuration, two laterally spaced projections are locked to the side retainer 24, the shield terminal 30 can be prevented from being tilted laterally.

Further, the front stops 58 are formed in planar regions (outer plate portions 52) of the outer surface of the outer conductor 43 different from a planar region (upper plate portion 51) where the first locking portion 55 is formed. The front stops 58 are configured to restrict a movement of the shield terminal 30 inserted into the first or second accommodation chamber 13 or 21 beyond a proper insertion position Since the planar regions (outer plate portions 52) where the front stops 58 are formed are different from the planar region (upper plate 51) where the first locking portion 55 is formed, the first locking lance 14 and the second locking lance 22 do not contact the front stops 58. Thus, insertion resistance due to the resilient interference of the front stops 58 with the first or second locking lance 14 or 22 is not generated.

The invention is not limited to the above described and illustrated embodiment. For example, the following embodiments also are included in the scope of the invention.

Although the first and second locking portions are disposed on the same plane of the outer surface of the outer conductor in the above embodiment, the first and second locking portions may be disposed on different planes of the outer surface of the outer conductor.

Although only one first locking portion is provided in the above embodiment, two or more first locking portions may be provided.

Although one pair of second locking portions are provided in the above embodiment, one, three or more second locking portions may be provided.

Although one pair of front stops are provided in the above embodiment, one, three or more front stop portions may be provided.

Although the second locking portions and the front stops are in the form of independent projections in the above embodiment, the second locking portions and the front stops may be formed integrally into one projection.

Although two inner conductors are accommodated into one dielectric in the above embodiment, one, three or more inner conductors may be accommodated into one dielectric.

Although the outer conductor is composed of two components, i.e. the first and second shells, in the above embodiment, the outer conductor may be composed of a single component.

Although two wires connected to the two inner conductors constitute the twisted pair cable in the above embodiment, the invention can be applied also when a wire connected to an inner conductor does not constitute a twisted pair cable.

LIST OF REFERENCE SIGNS

A . . . first shield connector (shield connector)
B . . . second shield connector (shield connector)
10 . . . first housing
13 . . . first accommodation chamber
14 . . . first locking lance
17 . . . front retainer
20 . . . second housing
21 . . . second accommodation chamber
22 . . . second locking lance
24 . . . side retainer
30 . . . shield terminal
32 . . . inner conductor
33 . . . body portion
34 . . . tab
40 . . . dielectric
43 . . . outer conductor
55 . . . first locking portion
57 . . . second locking portion
58 . . . front stop portion

The invention claimed is:

1. A shield terminal, comprising:

an inner conductor having a tab projecting forward from a body;

a dielectric configured to hold the inner conductor while accommodating the body; and an outer conductor surrounding the dielectric and the tab;

the shield terminal being mountable into a selected one of a first housing including a resiliently deflectable first locking lance, a front retainer capable of restricting resilient deflection of the first locking lance and a first accommodation chamber, and a second housing including a resiliently deflectable second locking lance, a second accommodation chamber and a side retainer facing inside of the second accommodation chamber, wherein:

a first locking portion and a second locking portion are formed on an outer surface of the outer conductor;

the shield terminal is retained by the front retainer restricting the resilient deflection of the first locking lance and the first locking portion being locked to the first locking lance when the shield terminal is inserted in the first accommodation chamber; and the shield terminal is retained by locking of the first locking portion and the second locking lance and locking of the second locking portion and the side retainer when the shield terminal is inserted in the second accommodation chamber.

2. The shield terminal of claim 1, wherein the first locking portion and the second locking portion are formed on the same plane of the outer surface of the outer conductor and disposed at different positions in a width direction intersecting an inserting direction into the first accommodation chamber or the second accommodation chamber.

3. The shield terminal of claim 2, wherein:

the first locking portion is disposed at a center position in the width direction intersecting the inserting direction into the first accommodation chamber or the second accommodation chamber; and two of the second locking portions are disposed on both sides across the first locking portion in the width direction.

4. The shield terminal of claim 1, further comprising a front stop portion formed in a planar region of the outer surface of the outer conductor different from a planar region where the first locking portion is formed, the front stop being configured to configured to restrict a movement of the shield terminal inserted into the first accommodation chamber or the second accommodation chamber beyond a proper insertion position.

5. A shield connector including a shield terminal with an inner conductor having a tab projecting forward from a body, a dielectric configured to hold the inner conductor while accommodating the body and an outer conductor surrounding the dielectric and the tab, the shield connector being configured by inserting the shield terminal into a selected one of a first accommodation chamber formed in a first housing and a second accommodation chamber formed in a second housing, comprising:

a resiliently deflectable first locking lance formed in the first accommodation chamber;

a front retainer configured to restrict resilient deflection of the first locking lance by being mounted into the first housing;

a resiliently deflectable second locking lance formed in the second accommodation chamber;

a side retainer mounted into the second housing to face inside of the second accommodation chamber;

a first locking portion formed on an outer surface of the outer conductor and configured to retain the shield terminal by being locked to the first locking lance when the shield terminal is inserted into the first accommodation chamber and to retain the shield terminal by being locked to the second locking lance when the shield terminal is inserted into the second accommodation chamber; and a second locking portion formed on the outer surface of the outer conductor and configured to retain the shield terminal by being locked to the side retainer when the shield terminal is inserted into the second accommodation chamber.

* * * * *